US011649129B2

(12) United States Patent
Mizuguchi

(10) Patent No.: US 11,649,129 B2
(45) Date of Patent: May 16, 2023

(54) SHEET DISCHARGE APPARATUS AND IMAGE FORMING APPARATUS

(71) Applicant: CANON KABUSHIKI KAISHA, Tokyo (JP)

(72) Inventor: Kohei Mizuguchi, Joso (JP)

(73) Assignee: Canon Kabushiki Kaisha, Tokyo (JP)

( * ) Notice: Subject to any disclaimer, the term of this patent is extended or adjusted under 35 U.S.C. 154(b) by 210 days.

(21) Appl. No.: 16/436,459

(22) Filed: Jun. 10, 2019

(65) Prior Publication Data

US 2020/0002116 A1 Jan. 2, 2020

(30) Foreign Application Priority Data

Jun. 27, 2018 (JP) ..... JP2018-122286

(51) Int. Cl.
*B65H 43/06* (2006.01)
*B65H 29/70* (2006.01)
(Continued)

(52) U.S. Cl.
CPC ..... *B65H 29/125* (2013.01); *B65H 7/14* (2013.01); *B65H 29/70* (2013.01);
(Continued)

(58) Field of Classification Search
CPC ..... B65H 31/26; B65H 43/06; B65H 29/125; B65H 29/70; B65H 7/14; B65H 2405/11;
(Continued)

(56) References Cited

U.S. PATENT DOCUMENTS 6,190,070 B1 * 2/2001 Urban ..... B65H 29/70 400/636
2009/0295061 A1 * 12/2009 Honda ..... B65H 29/14 271/3.14

(Continued)

FOREIGN PATENT DOCUMENTS

JP 10310311 A * 11/1998
JP 2005035753 A * 2/2005

(Continued)

*Primary Examiner* — Luis A Gonzalez
(74) *Attorney, Agent, or Firm* — Canon U.S.A., Inc. I.P. Division

(57) ABSTRACT

A sheet discharge apparatus includes a discharge and sheet support unit, a detection unit, a rotation member having a first abutting portion positioned above the sheet support unit, and a pressing member provided rotatably independent of the rotation member. The discharge unit nips and discharges a sheet in a sheet discharge direction. The sheet support unit supports the discharged sheet. The rotation member rotates when the first abutting portion is pressed by the sheet. The detection unit detects a position of the rotation member. A second abutting portion of the pressing member abuts against the sheet at a position downstream from a position at which the discharge unit nips the sheet and upstream from the first abutting portion in the sheet discharge direction. The pressing member presses the sheet discharged from the discharge unit downward using the second abutting portion, regardless of a position of the rotation member.

15 Claims, 6 Drawing Sheets

(51) Int. Cl.
*B65H 29/12* (2006.01)
*B65H 7/14* (2006.01)
*G03G 15/00* (2006.01)

(52) U.S. Cl.
CPC ..... *G03G 15/6552* (2013.01); *G03G 15/6573* (2013.01); *B65H 2301/5122* (2013.01); *B65H 2405/11* (2013.01); *G03G 2215/00556* (2013.01)

(58) Field of Classification Search
CPC ..... B65H 2301/5122; G03G 15/6552; G03G 15/6573; G03G 2215/00556
See application file for complete search history.

(56) References Cited

U.S. PATENT DOCUMENTS

2017/0107071 A1* 4/2017 Agata ..... B65H 31/02
2017/0248888 A1* 8/2017 Izumichi ..... G03G 15/6552

FOREIGN PATENT DOCUMENTS

JP 2005263354 A * 9/2005
JP 2006-306536 A 11/2006
JP 2010155681 A * 7/2010
JP 2011-230886 A 11/2011
JP 2014043289 A * 3/2014
JP 2016005983 A * 1/2016
JP 2017107118 A * 6/2017

* cited by examiner

SHEET DISCHARGE APPARATUS AND IMAGE FORMING APPARATUS

BACKGROUND

Field

The present disclosure relates to a sheet discharge apparatus that discharges sheets and an image forming apparatus including the same.

Description of the Related Art

Image forming apparatuses, such as a printer, a copying machine, and a multi-functional machine, include a sheet discharge apparatus that discharges sheets on which images are formed outside the apparatus main body. In many cases, the sheet discharge apparatus includes a discharge roller pair at an opening (discharge port) of the apparatus main body. The sheet discharge apparatus nips and conveys a sheet with the discharge roller pair to discharge the sheet onto a discharge tray. At that time, the trailing end of the discharged sheet can lean on the vicinity of the discharge port (hereinafter referred to as "trailing-end leaning"). If the trailing-end leaning occurs, the leaning sheet can block the discharge port to obstruct the discharge of the following sheet or disorder the sheets stacked on the discharge tray.

Japanese Patent Laid-Open No. 2006-306536 discloses a sheet discharge apparatus including a first flat for detecting that the sheets loaded on a discharge tray reaches a predetermined height (a full-loaded state) and a second flag for detecting a sheet leaning on the discharge port. The second flag comes into contact with the sheet at a position closer to the discharge roller than the first flag. These flags are operably connected via a stopper. The sheet discharge apparatus is configured to detect that at least one of the flags has rotated more than a predetermined angle with a photo-interrupter.

However, the apparatus disclosed in Japanese Patent Laid-Open No. 2006-306536 is configured to raise the second flag together with the first flag as a result of the sheet being discharged by the discharge roller pressing the first flag. In other words, the first flag presses the sheet downward at a position farther from the discharge roller than the second flag, and the weight of the second flag acts on the sheet via the first flag. This can cause the sheet to be pressed downward at a position distant from the discharge roller, with the trailing end of the sheet immediately after being discharged from the discharge roller left in the vicinity of the discharge roller, so that the sheet is curved, resulting in sufficient reduction of trailing-end leaning.

SUMMARY

The present disclosure provides a sheet discharge apparatus configured to electively reduce occurrence of trailing-end leaning and an image forming apparatus including the same.

According to an aspect of the present disclosure, a sheet discharge apparatus includes a discharge unit configured to nip a sheet and discharge the sheet in a sheet discharge direction, a sheet support unit configured to support the sheet discharged from the discharge unit, a rotation member having a first abutting portion positioned above the sheet support unit, wherein the rotation member is configured to rotate when the first abutting portion is pressed by the sheet, a detection unit configured to detect a position of the rotation member, and a pressing member having a second abutting portion configured to abut against the sheet at a position downstream from a position at which the discharge unit nips the sheet and upstream from the first abutting portion in the sheet discharge direction, wherein the pressing member is provided rotatably independent of the rotation member and presses the sheet discharged from the discharge unit downward using the second abutting portion, regardless of a position of the rotation member.

Further features of the present disclosure will become apparent from the following description of exemplary embodiments with reference to the attached drawings.

DESCRIPTION OF THE EMBODIMENTS

Embodiments of the present disclosure will be described hereinbelow with reference to the drawings.

First Embodiment

Figure 1:
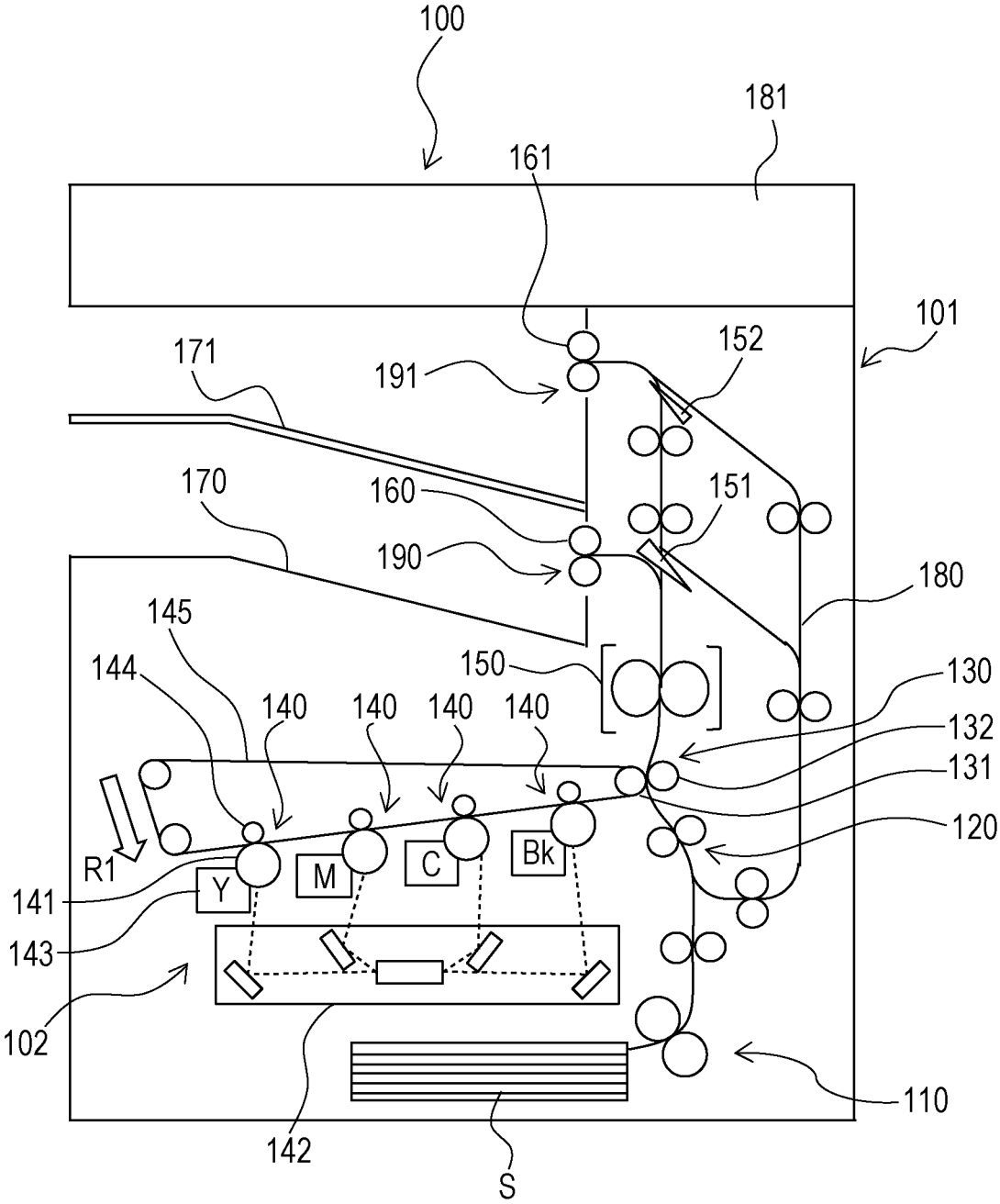
FIG. 1 is a schematic diagram of an image forming apparatus according to a first embodiment of the present disclosure.

FIG. 1 is a schematic diagram illustrating a cross-sectional configuration of an image forming apparatus 100 according to a first embodiment. The image forming apparatus 100 forms an image on a sheet S used as a printing medium based on image information input from an external PC or image information scanned from an original. Examples of the sheet S include paper, such as plain paper and cardboard, plastic film, such as a sheet for an overhead projector, sheets of special shapes, such as envelopes and index paper, and cloth.

The apparatus main body 101 of the image forming apparatus 100 houses an electrophotographic image forming section 102. The image forming section 102 is a so-called intermediate transfer type tandem electrophotographic unit in which four image forming units 140 that form toner images of four colors of yellow (Y), magenta (M), cyan (C), and black (Bk) are disposed along an intermediate transfer belt 145.

The image forming section 102 includes the image forming units 140, the intermediate transfer belt 145, an inner secondary transfer roller 131, and an outer secondary transfer roller 132. The intermediate transfer belt 145 functions as an image bearing member (an intermediate transfer member) of the present embodiment. The outer secondary transfer roller 132 in the present embodiment functions as a transfer unit that transfers toner images from the image bearing member to a printing medium.

An image forming process performed by the image forming section 102, which is an image forming unit of the present embodiment. Each image forming unit 140 includes a photosensitive drum 141, which is an electrophotographic photosensitive member, a developing unit 143, and a primary transfer unit 144. The photosensitive drum 141 of each image forming unit 140 is configured to emit a laser beam from an exposure unit 142 provided at a lower part in the apparatus main body 101. When the image forming process is started, a laser beam is emitted from the exposure unit 142 to the photosensitive drum 141 whose surface is uniformly charged in advance by a charging unit, such as a charging roller, to expose the photosensitive drum 141. At that time, the exposure unit 142 receives a signal (a video signal) corresponding to the image data for printing and applies a laser beam modulated according to the video signal to the photosensitive drum 141 via a scanning optical system including a polygon mirror. Thus, an electrostatic latent image corresponding to the image data is formed on the surface of the photosensitive drum 141.

The developing unit 143 supplies toner to the electrostatic latent image formed on the photosensitive drum 141 to visualize (develop) the latent image to a toner image. Thereafter, predetermined pressure and electrostatic load bias are applied by the primary transfer unit 144, so that the toner image is primarily transferred from the photosensitive drum 141 to the intermediate transfer belt 145.

The intermediate transfer belt 145 is rotationally driven in the direction of arrow R1 in FIG. 1. The above toner image forming operation is performed in parallel in the individual image forming units 140. The primary transfer is performed on the intermediate transfer belt 145 so that toner images formed by downstream image forming units 140 are put on toner images formed by upstream image forming units 140. As a result, a full-color toner image is formed on the intermediate transfer belt 145 and conveyed to a secondary transfer unit 130 while being carried on the intermediate transfer belt 145.

The secondary transfer unit 130 is a nip formed by the inner secondary transfer roller 131 and the outer secondary transfer roller 132 facing each other. The secondary transfer unit 130 transfers the toner image from the intermediate transfer belt 145 to the sheet S while conveying the nipped sheet S. In other words, the toner image is transferred from the intermediate transfer belt 145 to the sheet S as a result of the outer secondary transfer roller 132 applying predetermined pressure and electrostatic load bias. Thereafter, the sheet S is conveyed to a fixing unit 150, which is a heater that applies heat to the toner image. The fixing unit 150 applies heat and pressure to the toner image while conveying the sheet S nipped by a rotating body pair, such as a roller pair and a belt. Thus, the toner is melted and thereafter solidified to be firmly fixed to the sheet S, so that the image is fixed to the sheet S.

A process for conveying the sheet S is executed in parallel to the above image forming process. First, the sheet S used as a printing medium is supplied to the image forming section 102 by a sheet feeding unit 110. The sheet feeding unit 110 includes a cassette including an elevator that is raised or lowered, with the sheets S loaded on the cassette, and a feeding unit that feeds the sheets S from the cassette one by one. The sheet S fed by the feeding unit is conveyed to a skew correction apparatus 120 through a conveying path. The skew correction apparatus 120 corrects the skew of the sheet S and conveys the sheet S to the secondary transfer unit 130 at the timing determined in accordance with the toner image forming operation performed by the image forming section 102.

The sheet S on which the toner image is transferred by the secondary transfer unit 130 and is then fixed by the fixing unit 150 reaches a junction point at which a first switch flap 151 is disposed. The first switch flap 151 guides the sheet S to either of a sheet conveying path to a first discharge unit 190 and a sheet conveying path to a second discharge unit 191. The sheet S guided to the first discharge unit 190 is discharged by a first discharge roller pair 160 onto a first discharge tray 170 disposed at an upper part in the apparatus main body 101.

The sheet S guided to the second discharge unit 191 is discharged by a second discharge roller pair 161 onto a second discharge tray 171 disposed above the first discharge tray 170 or reversely conveyed by the reversing operation of a second discharge roller pair 161. For duplex printing, the reversed sheet S is guided to a duplex conveying path 180 by a second switch flap 152 and is again conveyed to the skew correction apparatus 120 through the duplex conveying path 180. The sheet S that has reached the skew correction apparatus 120 is subjected to the same process as the process on the first side on which the image is formed and is thereafter discharged to the discharge tray 170 or 171.

An image scanning apparatus 181 is disposed at the top of the apparatus main body 101. The image scanning apparatus 181 includes a platen on which a sheet (an original) is set and a scanning unit that optically scans the sheet set on the platen, and converts image information in the original to an electronic signal. The image data obtained in this way is transmitted to a control unit in the apparatus main body 101 and, for a copying operation, the image data is converted to a video signal and transmitted to the exposure unit 142.

Sheet Discharge Unit

Figure 2:
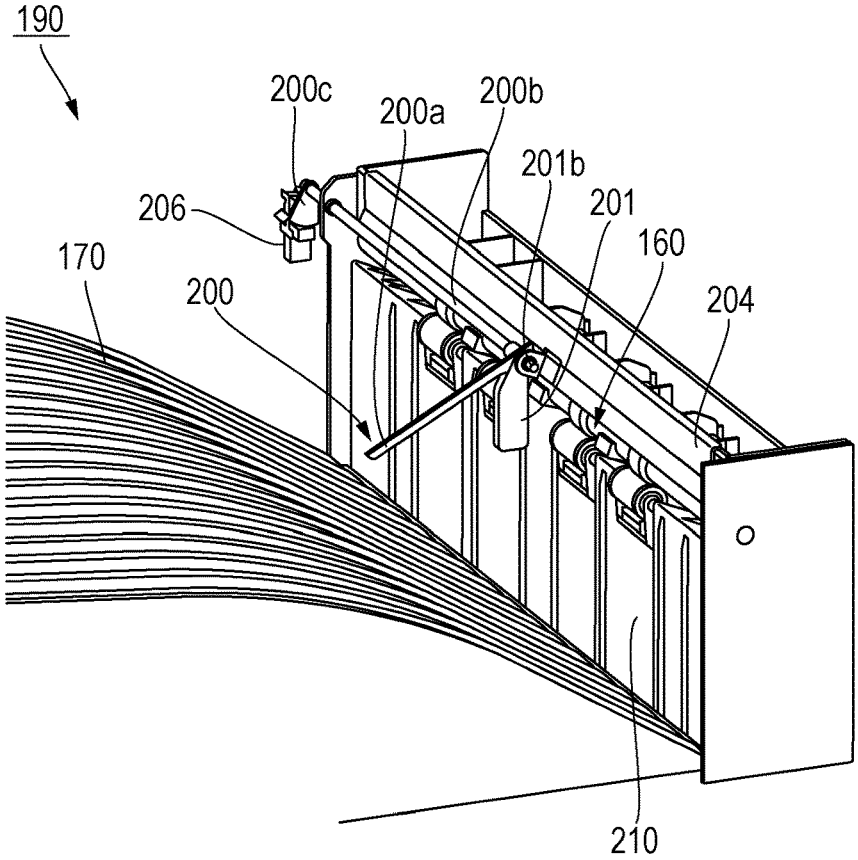
FIG. 2 is a perspective view of a sheet discharge unit according to the first embodiment.
Figure 3:
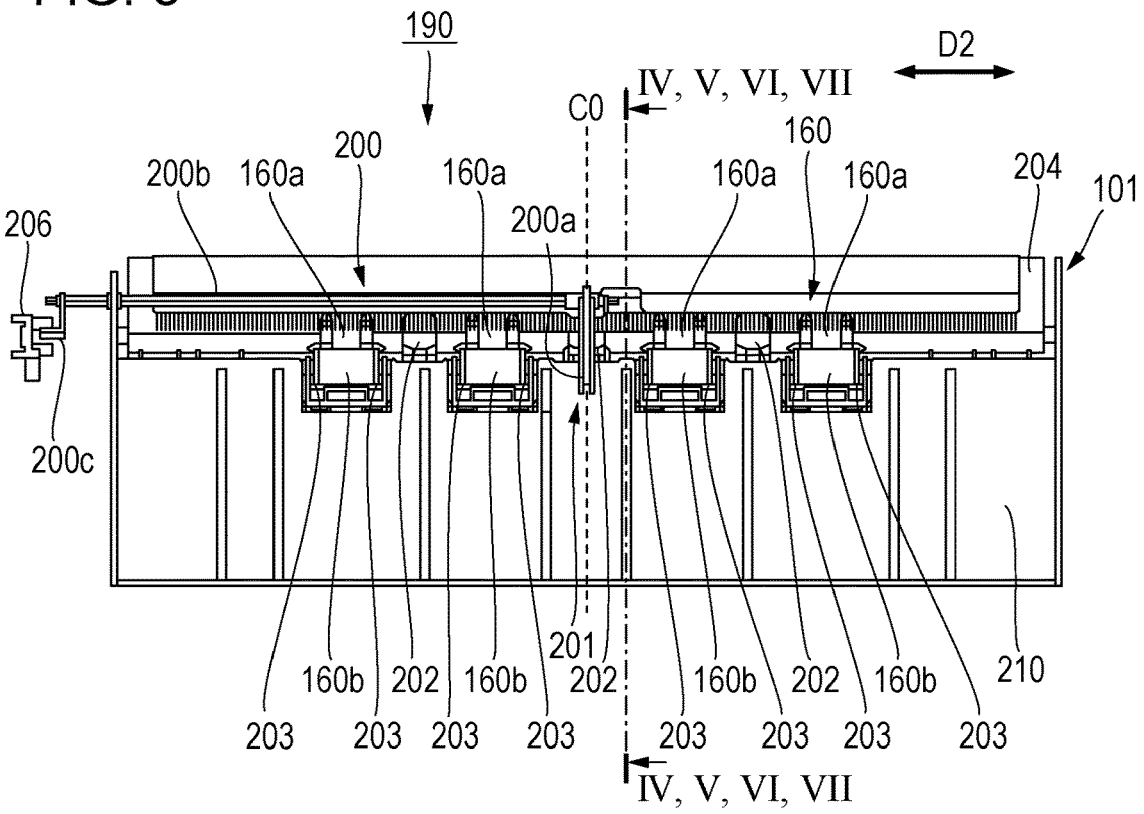
FIG. 3 is a side view of the sheet discharge unit according to the first embodiment.
Figure 4:
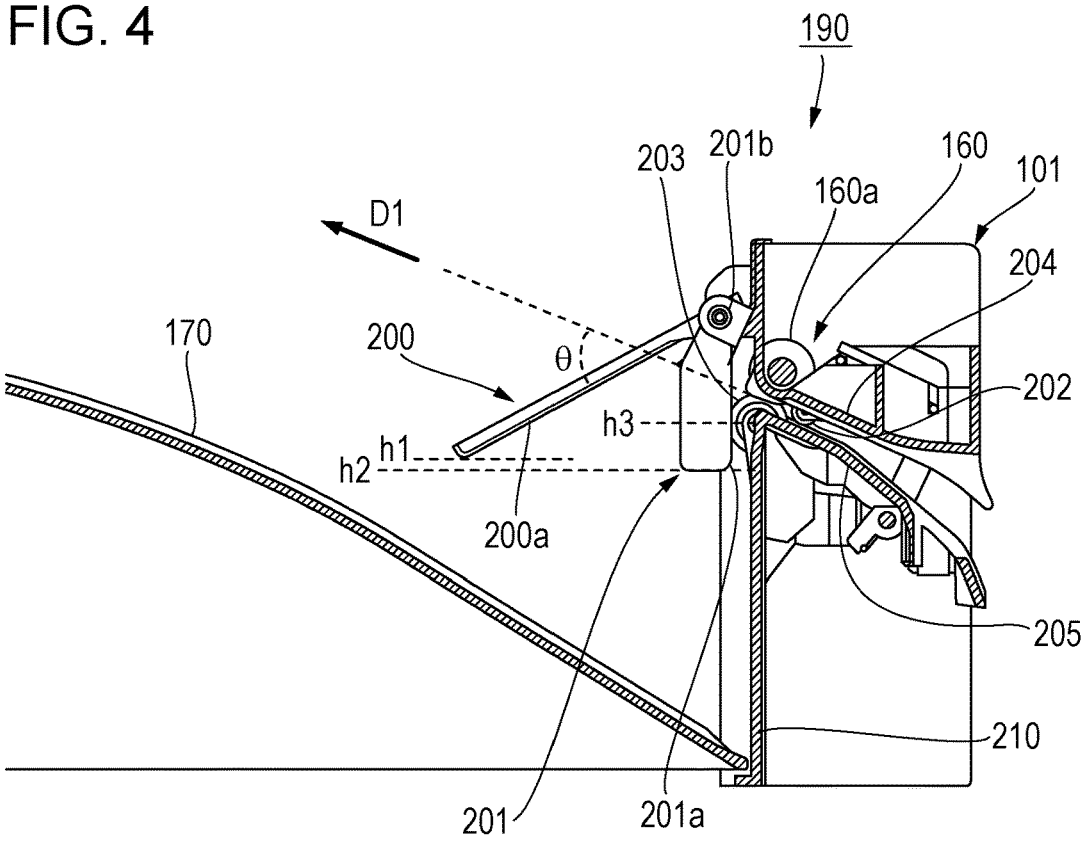
FIG. 4 is a cross-sectional view of the sheet discharge unit according to the first embodiment.

The configuration of the first discharge unit 190, which is a sheet discharge apparatus of the present embodiment, will be described with reference to FIGS. 2 to 4. FIG. 2 is a perspective view of the first discharge unit 190. FIG. 3 is a diagram of the first discharge unit 190 viewed from the downstream side in the sheet discharge direction (a view through the first discharge tray 170). FIG. 4 is a cross-sectional view of the first discharge unit 190 taken along line IV-IV in FIG. 3.

As illustrated in FIG. 2, the first discharge unit 190 includes the first discharge roller pair 160, the first discharge tray 170, and an alignment wall 210. The first discharge roller pair 160 is a discharge unit of the present embodiment, and the first discharge tray 170 is a sheet support unit of the present embodiment. The terms "discharge roller pair 160" and "discharge tray 170" hereinafter respectively refer to the first discharge roller pair 160 and the first discharge tray 170.

The discharge tray 170 is part of the casing of the apparatus main body 101 (see FIG. 1) and constitutes the upper surface of the apparatus main body 101. The image forming apparatus 100 of the present embodiment has a so-called in-drum discharge configuration in which sheet discharge space is provided in the space of the apparatus main body 101 in top view. The discharge tray 170 is inclined with respect to the horizontal plane so as to rise downstream in the sheet discharge direction. The first discharge unit 190 may be fitted with an accessary unit, such as a sheet processing unit, for example, for binding the sheets S, or a relay unit for conveying the sheets S to another sheet processing unit. In this case, the discharge roller pair 160 discharges the sheets S to the accessary unit.

As illustrated in FIG. 3, the discharge roller pair 160 includes a driving roller 160*a* connected to a drive source and a driven roller 160*b* driven to rotate by the driving roller 160*a*. The driving roller 160*a* is a first roller of the present embodiment, and the driven roller 160*b* is a second roller of the present embodiment, which nips the sheet S together with the first roller to convey the sheet S. The driving roller 160*a* and the driven roller 160*b* are disposed at multiple portions in the widthwise direction D2 of the sheet S (a direction perpendicular to the sheet discharge direction). Each driving roller 160*a* includes a rubber outer rim and is in contact with the roller main body of the opposing driven roller 160*b*. Each driven roller 160*b* has kicker units 203 and 203 with outside diameters larger than the outside diameter of the roller main body on both sides in the axial direction. The kicker units 203 and 203 are made of an elastic material, such as rubber or sponge. The kicker units 203 and 203 push out the trailing end of the sheet S (the upstream end in the sheet discharge direction) so that the sheet S completely comes out of the nip between the driving roller 160*a* and the driven roller 160*b*. The kicker unit 203 is an elastic unit of the present embodiment.

A stiffness imparting roller 202 is disposed between each pair of the driving roller 160*a* and the driven roller 160*b* in the widthwise direction. Each stiffness imparting roller 202 is disposed so as to protrude from one side to the other side (from above to below in the example in FIG. 3) in the thickness direction with respect to the nip between the driving roller 160*a* and the driven roller 160*b*. In other words, the stiffness imparting roller 202 is a stiffness imparting member of the present embodiment that enhances the stiffness of the sheet S that is being discharge by the discharge roller pair 160 by curving the sheet S viewed from the downstream side in the sheet discharge direction.

Each stiffness imparting roller 202 is rotatably supported by a lever member that is rotatable with respect to the apparatus main body 101 and is urged in the sheet pressing direction by a spring provided between the lever member and the apparatus main body 101. The configuration in which the stiffness imparting roller 202 can be displaced in the sheet thickness direction improves/refines the capability to respond to various sheets. In other words, in discharging a high-stiffness sheet, such as cardboard, the stiffness imparting roller 202 retracts upward in FIG. 3 to prevent a decrease in the abutment pressure between the driving roller 160*a* and the sheet S, thereby preventing conveyance failure. In discharging a low-stiffness sheet S, such as recycled paper or thin paper, the pressing force of the spring is higher than the stiffness of the sheet S, so that the stiffness imparting roller 202 curves the sheet S to enhance the stiffness of the sheet S. This reduces the possibility that the sheet S being discharged sags to disorder the sheets stacked on the discharge tray 170.

In discharging a high-stiffness sheet S, the sheet S is curved a little. However, the sheet S being discharged is unlikely to sag because of its high stiffness. In discharging a low-stiffness sheet S, the stiffness imparting roller 202 is retracted a little. However, a sufficient abutment pressure between the driving roller 160*a* and the sheet S is ensured because of the flexibility of the sheet S. The stiffness imparting roller 202 of the present embodiment is disposed so as to abut on a surface of the sheet S opposite to a surface on which an image is formed immediately before (a print surface) by the image forming section 102 (see FIG. 1). This prevents the stiffness imparting roller 202 from scraping the print surface to leave a mark on the image.

As illustrated in FIG. 4, the discharge roller pair 160 is disposed so as to discharge the sheet S in a sheet discharge direction D1 inclined with respect to the horizontal direction to move upward with an increasing distance from the alignment wall 210 as viewed in the widthwise direction. Specifically, a straight line perpendicular to a straight line connecting the axes of the driving rollers 160*a* and the axes of the driven rollers 160*b* is inclined with respect to the horizontal direction, as described above.

The alignment wall 210 is a wall surface extending upward from the upstream end of the discharge tray 170 in the sheet discharge direction D1 and constitutes part of the casing of the apparatus main body 101 together with the discharge tray 170. The sheet S discharged onto the discharge tray 170 slides along the inclination of the discharge tray 170 and abuts at the trailing end against the alignment wall 210 so that its position in the sheet discharge direction D1 is regulated.

The first discharge unit 190 includes an upper discharge guide 204 and a lower discharge guide 205 that guide the sheet S toward the discharge roller pair 160. The sheet conveying path that the upper discharge guide 204 and the lower discharge guide 205 form extends from the nip of the discharge roller pair 160 upstream in the sheet discharge direction D1 along the inclination of the sheet discharge direction D1 with respect to the horizontal direction. This guide shape reduces resistance in conveying the sheet S discharged by the discharge roller pair 160 and stabilizes the posture of the sheet S being discharged.

Full-Load Detection Flag and Pressing Member

As illustrated in FIGS. 2 and 3, the first discharge unit 190 further includes a full-load detection flag 200, a full-load detection sensor 206, and a pressing member 201. The full-load detection flag 200 is a detection flag of the present embodiment. The full-load detection sensor 206 is a detection unit of the present embodiment. The pressing member 201 is a pressing unit of the present embodiment.

The full-load detection flag 200 includes a rotary shaft 200*b* that is rotatably supported by the apparatus main body 101 and an abutting portion 200*a* and a light-shielding portion 200*c* which are mounted to the rotary shaft 200*b*. The abutting portion 200*a* is a first abutting portion of the present embodiment. The rotary shaft 200*b* extends in the widthwise direction. The abutting portion 200*a* is disposed within the range of the discharge tray 170 in the widthwise direction. The light-shielding portion 200*c* is disposed outside the discharge tray 170 in the widthwise direction. In the present embodiment, the abutting portion 200*a* is disposed at a conveying center C0 of the discharge roller pair 160 in the widthwise direction D2. The conveying center C0 is a central position in the range in which the discharge unit nips the sheet S, and in the present embodiment, a symmetry center in the widthwise direction of the four sets of driving roller 160*a* and driven roller 160*b*.

The full-load detection sensor 206 is a photo-interrupter configured to detect the position of the full-load detection flag 200. In other words, the full-load detection sensor 206 includes a light-emitting part and a light-receiving part that detects light emitted from the light-emitting part, and is configured to detect that the light-shielding portion 200*c* enters the optical path from the light-emitting part to the light-receiving part and blocks the light. The full-load detection sensor 206 is one example of a detection unit, for example, a sensor that detects the mechanical contact of a detection flag. The full-load detection flag 200 is configured to rest at a position where the abutting portion 200*a* is at a predetermined height h1 when not in contact with the sheet S, as illustrated in FIG. 4. When the sheets S are loaded beyond height h1, the full-load detection flag 200 rotates upward because the abutting portion 200*a* is pressed by the upper surface of the top sheet S. The full-load detection sensor 206 is disposed so as to be shielded by the light-shielding portion 200*c* when the full-load detection flag 200 rotates a predetermined angle from the rest position. The height of the abutting portion 200*a* when the detection signal from the full-load detection sensor 206 switches is the full-load height of the discharge tray 170 in the present embodiment.

As illustrated in FIGS. 2 and 3, the pressing member 201 includes a rotary shaft 201*b* that is rotatably supported by the apparatus main body 101 and an abutting portion 201*a* (FIG. 4) mounted to the rotary shaft 201*b*. The abutting portion 201*a* is a second abutting portion in the present embodiment. The pressing member 201 is disposed so as to rotate around the rotation center common to the full-load detection flag 200 (coaxially with the full-load detection flag 200). When the above accessary unit is mounted, the pressing member 201 and the full-load detection flag 200 are unmounted. The pressing member 201 may be detachably mounted to the apparatus main body 101 together with the full-load detection flag 200 by using, for example, a configuration in which the rotary shaft 201*b* has a boss shape that loosely fits on the rotary shaft 200*b* of the full-load detection flag 200.

The rotation radius of the pressing member 201 is smaller than the rotation radius of the full-load detection flag 200. The pressing member 201 is disposed so as to be aligned with the abutting portion 200*a* of the full-load detection flag 200 in the widthwise direction. In the present embodiment, the pressing member 201 is disposed at the conveying center C0 of the discharge roller pair 160 (FIG. 3). One of the stiffness imparting rollers 202 is also disposed at the conveying center C0. In other words, the abutting portion 201*a* of the pressing member 201, the abutting portion 200*a* of the full-load detection flag 200, and the stiffness imparting roller 202 are aligned in the widthwise direction.

As illustrated in FIG. 4, the pressing member 201 is configured to rest at a position where the abutting portion 201*a* is located at a predetermined height h2 when not in contact with the sheet S. The height h2 of the pressing member 201 at the resting position is set lower than the height h3 of the rotation center of the driven roller 160*b* of the discharge roller pair 160. In the present embodiment, the height h2 of the pressing member 201 at the resting position is set lower than the lower end of the driven roller 160*b* and the height h1 of the full-load detection flag 200 in the resting position. The distance from the loading surface of the discharge tray 170 to the pressing member 201 in the resting state is set larger than the distance from the loading surface to the full-load detection flag 200 at the resting position. This prevents the pressing member 201 from coming into contact with the sheets S on the tray before the discharge tray 170 becomes a full-loaded state to impede the rotation of the pressing member 201, hindering the discharge of the sheet S.

The pressing member 201 at the resting position overlaps with the driven roller 160*b* of the discharge roller pair 160 as viewed in the widthwise direction. Specifically, the pressing member 201 overlaps with the kicker units 203 of the driven roller 160*b*. The fact that two members overlap as viewed in a predetermined direction means that at least part of the projection range of one member overlaps with the projection range of the other member when the members are projected on a virtual plane perpendicular to a predetermined direction using parallel rays in the predetermined direction.

Sheet Discharge Operation

Figure 5:
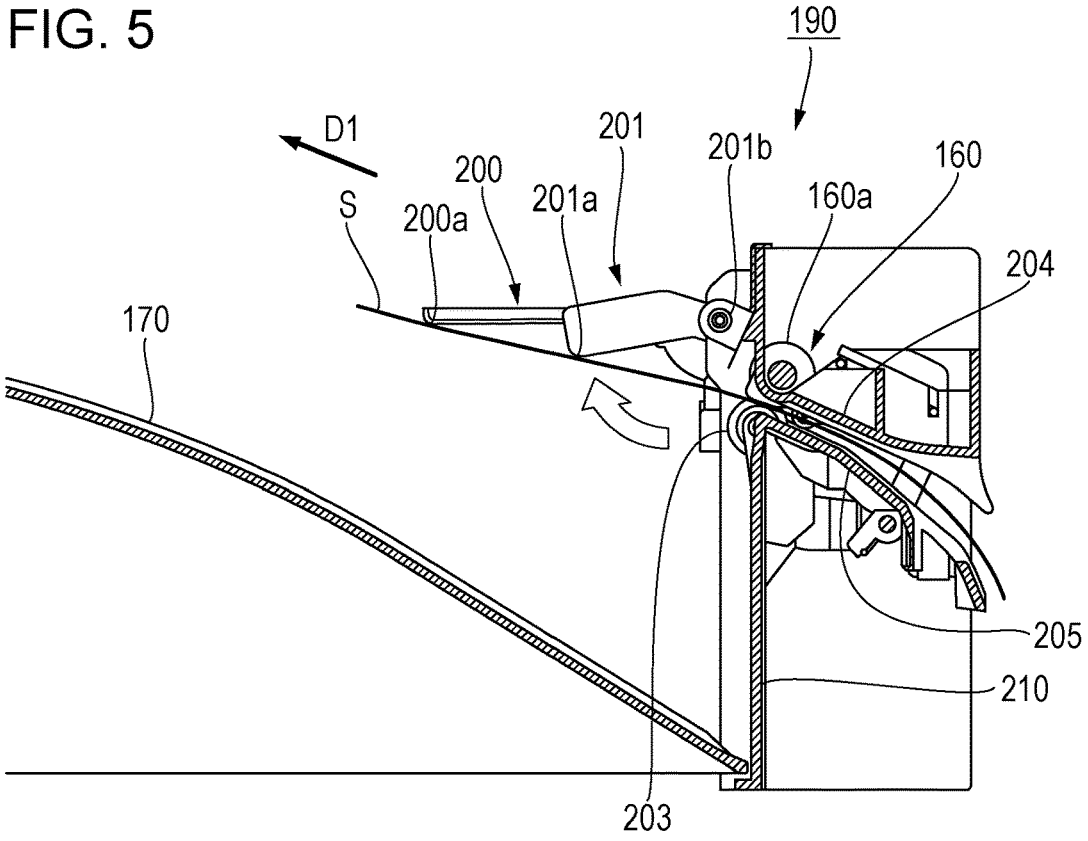
FIG. 5 is a cross-sectional view of the sheet discharge unit according to the first embodiment during execution of a sheet discharge operation.
Figure 6:
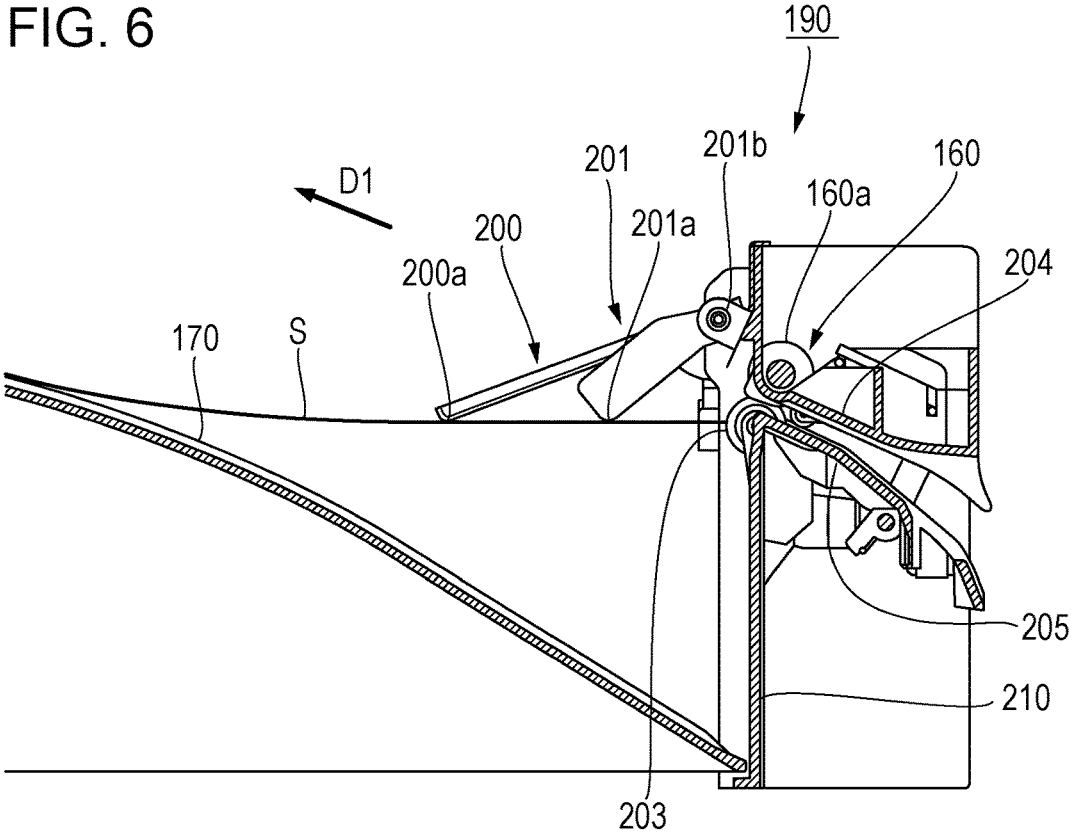
FIG. 6 is a cross-sectional view of the sheet discharge unit according to the first embodiment during execution of the sheet discharge operation.
Figure 7:
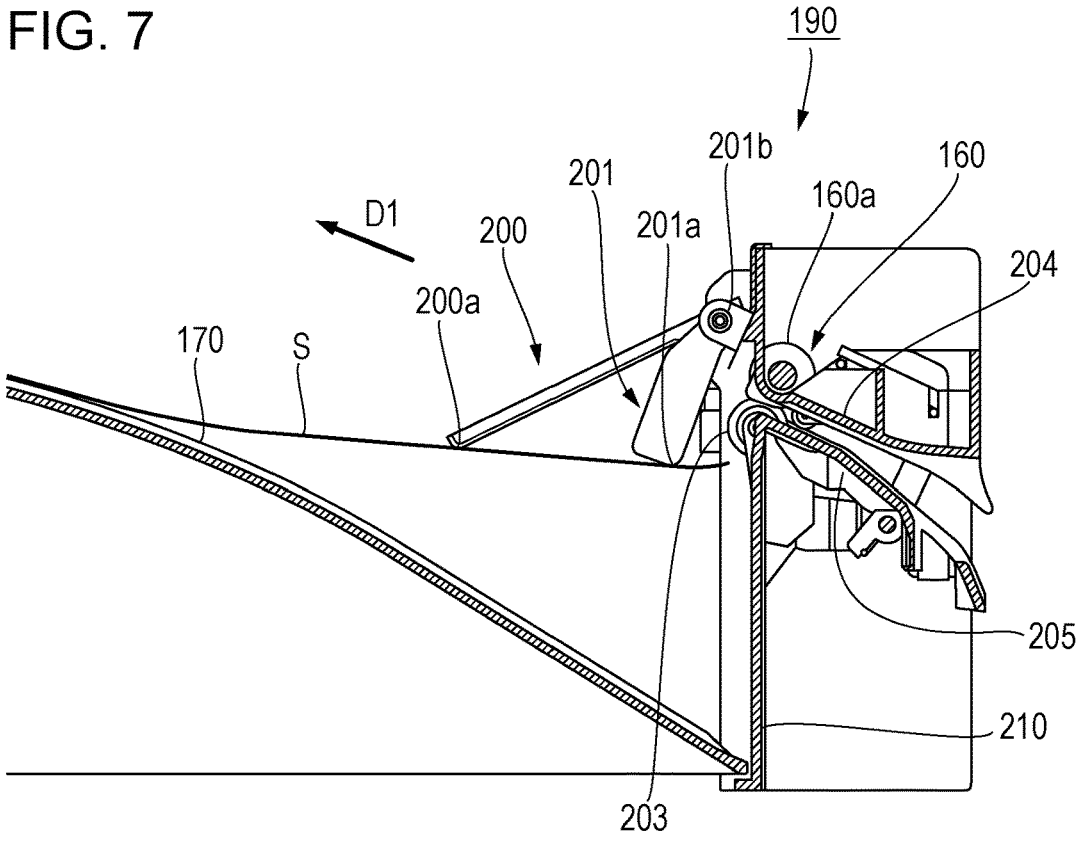
FIG. 7 is a cross-sectional view of the sheet discharge unit according to the first embodiment during execution of the sheet discharge operation.

The operations of the components when the thus-configured first discharge unit 190 performs a sheet discharge operation will be described. FIGS. 4 to 7 are respective cross-sectional views taken along lines IV-IV, V-V, VI-VI, and in FIG. 3. FIG. 4 illustrates a standby state and FIGS. 5, 6, and 7 illustrate states during the sheet discharge operation.

First, the standby state will be described with reference to FIG. 4. The full-load detection flag 200 is at the resting position (a standby position), and the end of the abutting portion 200*a* is at a position a predetermined distance away from the loading surface of the discharge tray 170. The abutting portion 200*a* extends in a direction intersecting the sheet discharge direction D1 at an angle of θ other than the right angle. In the present embodiment, θ is set at 45 (degrees) and may be set in the range of 30 to 60 (degrees). The pressing member 201 also stands by at the resting position (a standby position). The abutting portion 201*a* extends in the vertical direction. The angle that the abutting portion 201*a* of the pressing member 201 forms with the sheet discharge direction D1 viewed in the widthwise direction is nearer to 90 degrees than the angle θ that the abutting portion 200*a* of the full-load detection flag 200 forms with the sheet discharge direction D1.

As illustrated in FIG. 5, when the discharge roller pair 160 nips the sheet S and starts to discharge the sheet S, the leading end of the sheet S abuts against the abutting portion 201*a* of the pressing member 201 and then abuts against the abutting portion 200*a* of the full-load detection flag 200. The sheet S fed out of the discharge roller pair 160 is given stiffness by the operation of the stiffness imparting roller 202. The pressing member 201 and the full-load detection flag 200 are raised by the sheet S to rotate upward from the resting position. However, the upward rotation of the full-load detection flag 200 is restricted by a stopper (not illustrated) and is held at a posture in which the abutting portion 200*a* is substantially horizontal. This causes the leading end of the sheet S fed out of the discharge roller pair 160 to be guided toward the discharge tray 170 by the abutting portion 200*a*. The pressing member 201 presses the upper surface of the sheet S downward with its own weight. As the discharge of the sheet S proceeds, the stiffness imparting action at a position away from the stiffness imparting roller 202 becomes weak, so that the leading end of the sheet S deviates downward from the sheet discharge direction D1 onto the discharge tray 170.

FIG. 6 illustrates a state immediately after the trailing end of the sheet S comes out of the nip of the discharge roller pair 160. The trailing end of the sheet S is in contact with the kicker units 203 and receives friction from the kicker units 203 rotating in a rotational direction (counterclockwise in FIG. 6) along the sheet discharge direction D1. The pressing member 201 continuously presses the sheet S downward before the trailing end of the sheet S passes through the nip of the discharge roller pair 160. For this reason, when the trailing end of the sheet S passes through the nip of the discharge roller pair 160, the trailing end of the sheet S is pressed against the kicker units 203 by the pressing member 201. In other words, the pressure of the pressing member 201 increases the friction acting on the sheet S from the kicker units 203.

As illustrated in FIG. 7, when the trailing end of the sheet S moves downward to come away from the kicker units 203, there is nothing to support the trailing end of the sheet S, so that a portion of the sheet S near the trailing end falls toward the discharge tray 170. At that time, the sheet S is pressed downward by the full-load detection flag 200 and the pressing member 201 rotating in their resting positions. In particular, the pressing member 201 rotates to the resting position at which the end of the abutting portion 201*a* is lower than the kicker units 203, which prevents the trailing end of the sheet S from leaning against the nip of the discharge roller pair 160 or its periphery.

The above sheet discharge operation is repeated on the following discharged sheets S, so that the sheets S are stacked on the discharge tray 170. When the height of the sheets S stacked on the discharge tray 170 exceeds a predetermined height, the full-load detection flag 200 rotates, so that the full-load state is detected by the full-load detection sensor 206.

Beneficial Effects of Present Embodiment

As described above, the present embodiment includes the pressing member 201 that abuts on the sheet S at a position nearer to the discharge roller pair 160 than the full-load detection flag 200, in addition to the full-load detection flag 200 that abuts against the sheet S above the discharge tray 170. The pressing member 201 is configured to rotate independently of the full-load detection flag 200 so as to press the sheet S being discharged by the discharge roller pair 160 downward regardless of the position of the full-load detection flag 200. In other words, the pressing unit that is rotatable independently of the detection flag is configured to press the sheet S discharged from the discharge unit downward with the second abutting portion regardless of the position of the detection flag.

This configuration provides a state in which the pressing member 201 presses the sheet S downward at a position closer to the discharge roller pair 160 than the abutting portion 200*a* of the full-load detection flag 200 at the point in time the trailing end of the sheet S passes through the nip of the discharge roller pair 160. This allows the trailing end of the sheet S that has passed through the nip of the discharge roller pair 160 to quickly move downward away from the discharge roller pair 160, thereby efficiently reducing occurrence of trailing-end leaning.

In the present embodiment, the discharge roller pair 160 discharges the sheet S in the obliquely upward sheet discharge direction D1, and the stiffness imparting roller 202 imparts stiffness on the sheet S discharged by the discharge roller pair 160. This stabilizes the posture of the sheet S being discharged using the stiffness imparting working of the stiffness imparting roller 202 and reduces the occurrence of trailing-end leaning immediately after the discharging by the working of the pressing member 201. In particular, the present embodiment is configured such that the pressing member 201 presses the sheet S from the same direction as the direction of the stiffness imparting roller 202 (from above) and that the positions of the pressing member 201 and the central stiffness imparting roller 202 are aligned in the widthwise direction. This minimizes the influence of the pressing member 201 on the posture of the sheet S being discharged.

In the present embodiment, the pressing member 201 overlaps with the kicker units 203 (elastic portions) provided at the driven roller 160*b* as viewed in the axial direction of the discharge roller pair 160. This allows the trailing end of the sheet S that has passed through the nip of the discharge roller pair 160 to be pressed against the kicker units 203 by the pressure of the pressing member 201, increasing the friction of the kicker units 203 on the sheet S. As a result, as the kicker units 203 rotate, the trailing end of the sheet S is separated from the nip of the discharge roller pair 160 while being kept in contact with the kicker units 203, which prevents the occurrence of trailing-end leaning more reliably.

In the present embodiment, the abutting portion 200*a* the full-load detection flag 200 and the abutting portion 201*a* of the pressing member 201 are disposed at the conveying center C0 of the discharge roller pair 160. This prevents the conveying resistance to the sheet S from being uneven on one side and the other side of the conveying center C0 in the widthwise direction. Furthermore, this allows the full-load detection flag 200 and the pressing member 201 to give a certain effect to the sheet S regardless of the width of the sheet S.

In the present embodiment, the pressing member 201 for pressing the sheet S is disposed at a position closer to the discharge roller pair 160 than the full-load detection flag 200. Moving the abutting portion 200*a* of the full-load detection flag 200 itself to the position of the abutting portion 201*a* of the pressing member 201 is disadvantageous in the following points. First, moving the abutting portion 200*a* of the full-load detection flag 200 close to the discharge roller pair 160 makes the angle θ (see FIG. 4) between the abutting portion 200*a* in the resting position and the sheet discharge direction D1 close to a right angle, which can increase the sheet conveying resistance. Furthermore, since it is necessary to detect the full-load state before the sheets S loaded on the discharge tray 170 blocks the discharge roller pair 160, the rotation radius of the full-load detection flag 200 has to be set somewhat large, for example, the abutting portion 200*a* is extended lower than the discharge roller pair 160. This causes the abutting position of the abutting portion 200*a* against the sheet S to be more separated from the discharge roller pair 160 than the abutting portion 201*a* of the pressing member 201 of the present embodiment, so that the effect of quickly separating the trailing end of the sheet S that has passed through the discharge roller pair from the discharge roller pair is not provided. Furthermore, even if the rotation radius is set small using a light-weight full-load detection flag that will not increase the conveying resistance, the sheet height for detecting a full-load state and the height of the discharge roller pair come close to each other, leading to the risk of blocking the discharge roller pair. The configuration of the present embodiment prevents such inconveniences because of the pressing member 201 that rotates independently of the full-load detection flag 200.

In the present embodiment, the rotation range of the full-load detection flag 200 is limited, as described above, so that the upward rotation of the abutting portion 200*a* beyond the substantially horizontal position is restricted (see FIG. 5). This is for the purpose of preventing the sheet S discharged by the discharge roller pair 160 from being continuously discharged at the obliquely upward posture. If the rotation range of the full-load detection flag 200 is not limited, when the sheet S that has passed through the discharge roller pair 160 falls, the sheet S can be moved by receiving a force opposite to the sheet discharge direction D1 due to air resistance to lean against the nip of the discharge roller pair 160 or the periphery thereof. Such behavior tends to occur when a sheet that has certain stiffness, such as thin paper, and that can easily be curved by the stiffness imparting roller 202 (in other words, a sheet whose leading end is hard to sag) is discharged. Since the present embodiment is configured to guide the leading end of the sheet S with the full-load detection flag 200 whose rotation range is limited, the sheet S can be landed on the discharge tray 170 before the trailing end of the sheet S passes through the discharge roller pair 160, thus preventing such inconvenience.

In order to prevent the behavior of the sheet S that has passed through the discharge roller pair 160 moving opposite to the sheet discharge direction D1, the stiffness imparting working of the stiffness imparting roller 202 may be weakened (for example, a spring for urging the stiffness imparting roller 202 is weakened). However, this configuration may reduce the stiffness imparted to a low-stiffness sheet, such as recycled paper, making it difficult to maintain the posture of the sheet being discharged, for example, causing the sheet to come into contact with the discharge tray 170 to be bent. It is also possible to apply air to the lower surface of the low-stiffness sheet S being discharged from a fan provided in the apparatus main body so as to support the posture of the sheet S. This however has an issue in terms of cost and noise. Furthermore, decreasing the space in the vertical direction between the discharge tray 170 and the discharge roller pair 160 leads to a short fall length, allowing the above behavior of the sheet S to be reduced. However, this reduces the load capacity of the discharge tray 170 because it is necessary to determine that the discharge tray 170 is full of sheets S before the loaded sheets S block the discharge roller pair 160. The configuration of the present embodiment reduces the trailing-end leaning of the sheet S while avoiding these inconveniences.

Modification

Although the present embodiment uses, as a stiffness imparting member, the stiffness imparting roller 202 provided independently of the discharge roller pair 160, another configuration may be used. For example, a roller whose outside diameter is larger than the outside diameter of the driving roller 160*a* or the driven roller 160*b* may be disposed on the roller shaft of the driving roller 160*a* or the driven roller 160*b*. Although the stiffness imparting roller 202 in the present embodiment is disposed opposite to the print surface of the sheet S, the stiffness imparting roller 202 may be disposed on the same side as the print surface.

The discharge roller pair 160 is one example of the discharge unit. Another configuration may be used. For example, two pairs of driving roller 160*a* and driven roller 160*b* forming a nip may be provided. The discharge roller pair may be configured such that a plurality of driving rollers and a plurality of driven rollers are alternately disposed in the axial direction and that the outer circumferential surfaces of the driving rollers and the driven rollers are aligned viewed in the axial direction. In this case, the discharge roller pairs also serve as stiffness imparting members for imparting stiffness to the sheet S.

Second Embodiment

Figure 8:
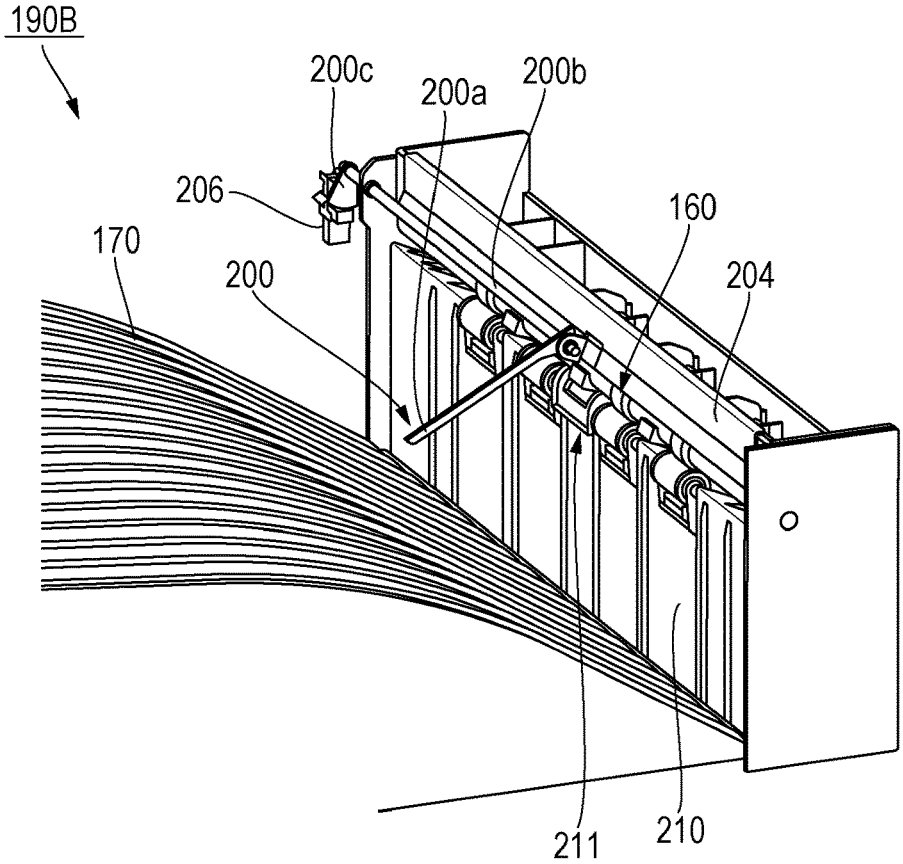
FIG. 8 is a perspective view of a sheet discharge unit according to a second embodiment of the present disclosure.
Figure 9:
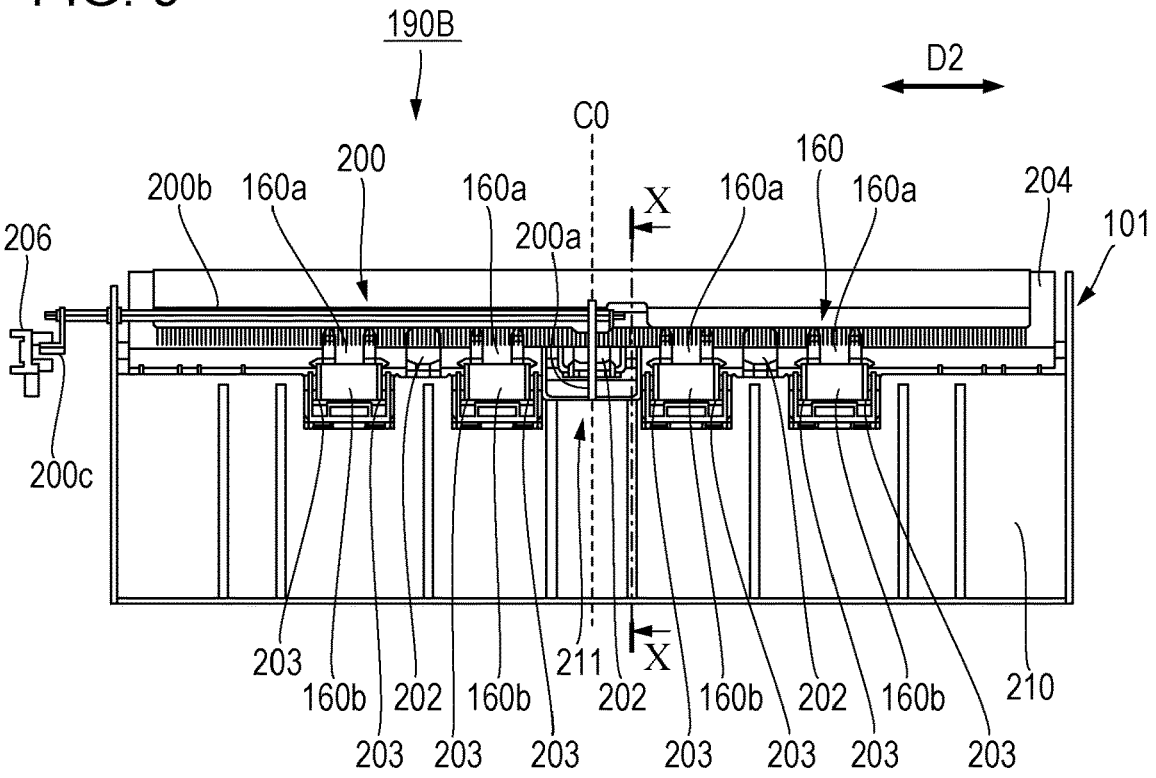
FIG. 9 is a side view of the sheet discharge unit according to the second embodiment.
Figure 10:
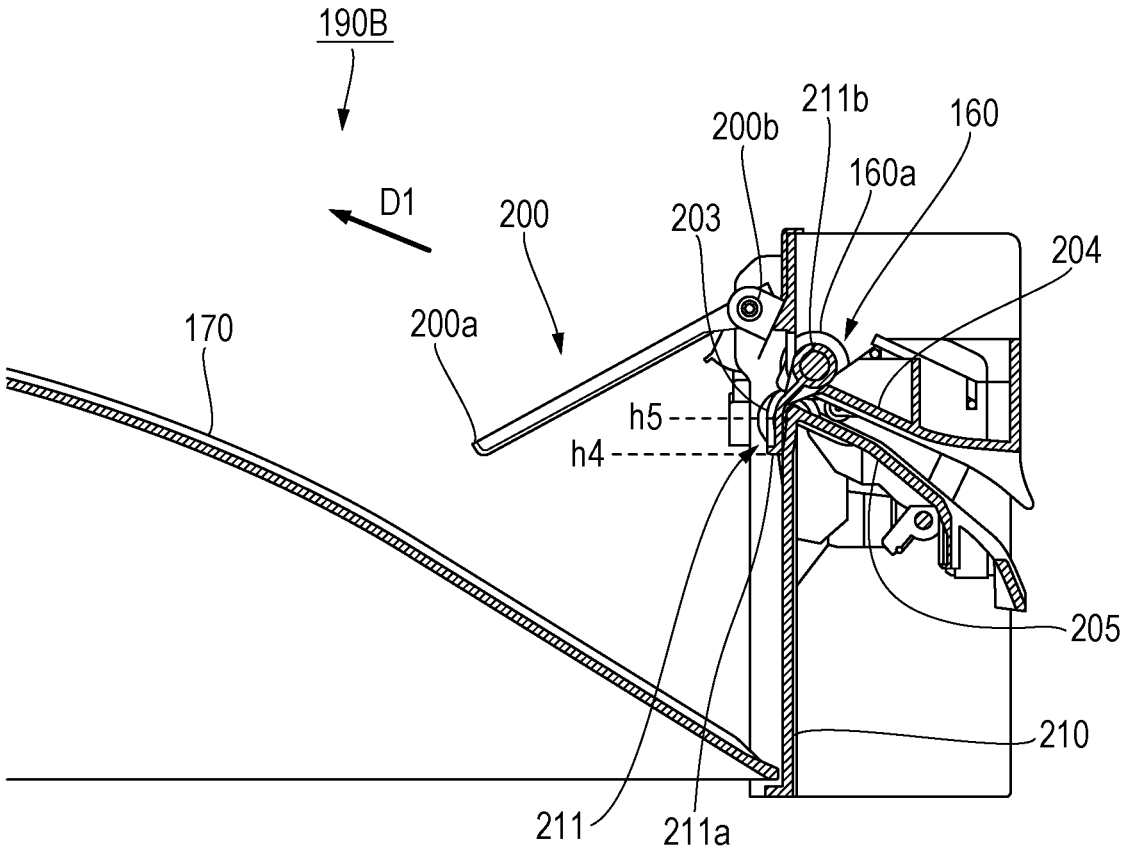
FIG. 10 is a cross-sectional view of the sheet discharge unit according to the second embodiment.

A sheet discharge apparatus according to a second embodiment will be described with reference to FIGS. 8 to 10. FIG. 8 is a perspective view of a first discharge unit 190B, which is the sheet discharge apparatus of the present embodiment. FIG. 9 is a diagram of the first discharge unit 190B viewed from the downstream side in the sheet discharge direction. FIG. 10 is a cross-sectional view of the first discharge unit 190B taken along line X-X in FIG. 9. The first discharge unit 190B is a sheet discharge apparatus that discharges sheets S from the apparatus main body 101 of the image forming apparatus 100, like the first discharge unit 190 of the first embodiment, and differs in the configuration of a pressing member 211 from the configuration of the pressing member 201 of the first embodiment. The other components having the same configuration and operations as those of the first embodiment are given the same reference numerals as those of the first embodiment and descriptions thereof will be omitted.

As illustrated in FIGS. 8 and 9, the pressing member 211, which is a pressing unit of the present embodiment, is rotationally supported by apparatus main body 101. The pressing member 211 is disposed at the conveying center C0 of the discharge roller pair 160 in the widthwise direction (FIG. 9).

As illustrated in FIG. 10, the pressing member 211 includes a rotary shaft 211*b* rotatably supported by the apparatus main body 101 and an abutting portion 211*a* mounted to the rotary shaft 211*b*. The pressing member 211 is configured to rest at a position where the abutting portion 211*a* is located at a predetermined height h4 when not in contact with the sheet S. The height h4 of the pressing member 211 at the resting position is set lower than the height h5 of the rotation center of the driven roller 160*b* of the discharge roller pair 160. The pressing member 211 at its resting position overlaps with the driven roller 160*b* of the discharge roller pair 160 as viewed in the widthwise direction.

Also the use of the pressing member 211 allows the pressing member 211 to press the sheet S downward at a position closer to the discharge roller pair 160 than the abutting portion 200*a* of the full-load detection flag 200 at the time the trailing end of the sheet S passes through the nip of the discharge roller pair 160. This allows the trailing end of the sheet S that has passed through the nip of the discharge roller pair 160 to quickly move downward away from the discharge roller pair 160, thereby efficiently reducing occurrence of trailing-end leaning, as in the first embodiment.

Unlike the first embodiment, the pressing member 211 of the second embodiment is disposed so as to rotate about the rotation center of the driving roller 160*a* of the discharge roller pair 160 (in other words, coaxially with the driving roller 160*a*). This allows the abutting portion 211*a* of the pressing member 211 to abut against the sheet S at a position closer to the nip of the discharge roller pair 160, thereby pressing the trailing end of the sheet S that has passed through the nip downward. This makes it easy to press the trailing end of the sheet S against the kicker units 203 of the driven roller 160*b*, thereby applying friction. Furthermore, since the abutting position of the pressing member 211 against the sheet S being discharged is close to the stiffness imparting roller 202, the probability that the pressing force of the pressing member 211 causes the sheet S to sag can be reduced.

Although the present embodiment has a configuration in which the pressing member 211 is disposed coaxially with the driving roller 160*a* of the discharge roller pair 160, a pressing unit that has a rotation center at another position may be used. Also this configuration provides the same beneficial advantages as those of the first and second embodiments by providing a pressing unit that presses the sheet S at a position closer to the discharge roller pair 160 than the full-load detection flag 200.

OTHER EMBODIMENTS

Although the first and second embodiments illustrate sheet discharge apparatuses that discharge sheets from the apparatus main body 101 of the image forming apparatus 100, this technique is also applicable to another sheet discharge apparatus. The second discharge unit 191 in the first embodiment is an example of another sheet discharge apparatus. Other examples include a sheet discharge apparatus for discharging an original from which image information is read by an image scanning apparatus and a sheet discharge apparatus for discharging a sheet processed by a sheet processing apparatus.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-122286, filed Jun. 27, 2018, which is hereby incorporated by reference herein in its entirety.

What is claimed is:

1. A sheet discharge apparatus comprising:

a discharge unit configured to nip a sheet at a nipping portion and discharge the sheet in a sheet discharge direction;

a sheet support unit configured to support the sheet discharged from the discharge unit;

a rotation member having a first abutting portion positioned above the sheet support unit, wherein the rotation member is configured to rotate about an axial line when the first abutting portion is pressed by the sheet;

a detection unit configured to detect a position of the rotation member;

a pressing member having a second abutting portion configured to abut against the sheet at a position downstream from a position at which the discharge unit nips the sheet and upstream from the first abutting portion in the sheet discharge direction; and a curving member configured to curve the sheet discharged by the discharge unit as viewed from a downstream side in the sheet discharge direction, wherein the curving member curves the sheet by pressing a part of the sheet being nipped by the nipping portion of the discharge unit downward such that the part of the sheet pressed by the curving member is positioned below the nipping portion, wherein the pressing member is provided rotatably independent of the rotation member and is configured to press the sheet discharged from the discharge unit downward, regardless of the position of the rotation member, wherein a length of the pressing member is shorter than a length of the rotation member in a direction perpendicular to the axial line, and wherein both of the second abutting portion and the curving member are provided at a center of the discharge unit in a sheet widthwise direction that is perpendicular to the sheet discharge direction.

2. The sheet discharge apparatus according to claim 1, wherein the sheet discharge direction is inclined upward with an increasing distance from the discharge unit in a horizontal direction as viewed in the sheet widthwise direction.

3. The sheet discharge apparatus according to claim 1, wherein the detection unit includes a sensor configured to detect that the rotation member has rotated a predetermined angle from a position where the rotation member is not in contact with the sheet, regardless of a position of the pressing member.

4. The sheet discharge apparatus according to claim 1, wherein the discharge unit includes a first roller configured to come into contact with an upper surface of the sheet and a second roller configured to come into contact with a lower surface of the sheet, wherein a rotation center of the pressing member is higher than a rotation center of the second roller, and wherein, when the pressing member is not in contact with the sheet, the second abutting portion extends lower than the rotation center of the second roller.

5. The sheet discharge apparatus according to claim 4, wherein the second roller includes a plurality of roller main bodies configure to be in contact with the first roller on outer circumferential surfaces and a plurality of elastic portions made of an elastic material, wherein the plurality of elastic portions is larger in outside diameter than an outside diameter of the plurality of roller main bodies, and wherein, when the pressing member is not in contact with the sheet, the pressing member and the plurality of elastic portions are overlapped as viewed in an axial direction of the second roller.

6. The sheet discharge apparatus according to claim 4, wherein, when the pressing member is not in contact with the sheet, the second abutting portion extends lower than a lower end of the second roller.

7. The sheet discharge apparatus according to claim 4, wherein the pressing member is configured to rotate around a rotation center of the first roller.

8. The sheet discharge apparatus according to claim 1, wherein the pressing member is configured to rotate around a rotation center of the rotation member.

9. The sheet discharge apparatus according to claim 1, wherein, when both of the rotation member and the pressing member are not in contact with the sheet, the second abutting portion is positioned lower than the first abutting portion.

10. The sheet discharge apparatus according to claim 1, wherein the first abutting portion is provided at the center of the discharge unit in the sheet widthwise direction.

11. The sheet discharge apparatus according to claim 1, wherein the rotation member is rotated by being pressed by the sheet supported by the sheet support unit.

12. The sheet discharge apparatus according to claim 1, wherein, in a state in which neither the rotation member nor the pressing member is in contact with the sheet, a distance between a stacking surface of the sheet support unit on which sheets are stackable and the rotation member is shorter than a distance between the stacking surface of the sheet support unit and the pressing member.

13. The sheet discharge apparatus according to claim 1, wherein the discharge unit includes another nipping portion arranged at a position different from the nipping portion in the sheet widthwise direction, and the curving member and the second abutting portion of the pressing member are arranged between the nipping portion and the another nipping portion in the sheet widthwise direction.

14. An image forming apparatus comprising:

an image forming section configured to form an image on a sheet;

a discharge unit configured to nip the sheet on which the image is formed by the image forming section at a nipping portion and discharge the sheet in a sheet discharge direction;

a sheet support unit configured to support the sheet discharged from the discharge unit;

a rotation member having a first abutting portion positioned above the sheet support unit, wherein the rotation member is configured to rotate about an axial line when the first abutting portion is pressed by the sheet;

a detection unit configured to detect a position of the rotation member;

a pressing member having a second abutting portion configured to abut against the sheet at a position downstream from a position at which the discharge unit nips the sheet and upstream from the first abutting portion in the sheet discharge direction; and a curving member configured to curve the sheet discharged by the discharge unit as viewed from a downstream side in the sheet discharge direction, wherein the curving member curves the sheet by pressing a part of the sheet being nipped by the nipping portion of the discharge unit downward such that the part of the sheet pressed by the curving member is positioned below the nipping portion, wherein the pressing member is provided rotatably independent of the rotation member and is configured to press the sheet discharged from the discharge unit downward, regardless of the position of the rotation member, wherein a length of the pressing member is shorter than a length of the rotation member in a direction perpendicular to the axial line, and wherein both of the second abutting portion and the curving member are provided at a center of the discharge unit in a sheet widthwise direction that is perpendicular to the sheet discharge direction.

15. The sheet discharge apparatus according to claim 1, wherein the pressing member abuts on the sheet being curved by the curving member, and wherein the pressing member is arranged so that the pressing member presses the sheet after the sheet passes the curving member.

* * * * *